US008739567B2

(12) United States Patent
Junge

(10) Patent No.: US 8,739,567 B2
(45) Date of Patent: Jun. 3, 2014

(54) DUAL EVAPORATOR REFRIGERATION SYSTEM USING ZEOTROPIC REFRIGERANT MIXTURE

(75) Inventor: Brent Alden Junge, Evansville, IN (US)

(73) Assignee: General Electric Company, Schenectady, NY (US)

( * ) Notice: Subject to any disclaimer, the term of this patent is extended or adjusted under 35 U.S.C. 154(b) by 162 days.

(21) Appl. No.: 13/492,054

(22) Filed: Jun. 8, 2012

(65) Prior Publication Data

US 2013/0327078 A1 Dec. 12, 2013

(51) Int. Cl.
*F25B 7/00* (2006.01)

(52) U.S. Cl.
USPC ..... 62/335

(58) Field of Classification Search
CPC ..... F25B 7/00; F25B 39/028; F25B 39/02; F25D 23/069; F25D 11/022
USPC ..... 62/335, 441, 442, 504
See application file for complete search history.

(56) References Cited

U.S. PATENT DOCUMENTS

| | | | | |
|---|---|---|---|---|
| 2,182,318 | A * | 12/1939 | Newill | 62/200 |
| 2,682,756 | A | 2/1952 | Clark et al. | |
| 4,493,193 | A * | 1/1985 | Fisher | 62/160 |
| 4,771,610 | A | 9/1988 | Nakashima et al. | |
| 5,076,064 | A | 12/1991 | Kopko | |
| 5,235,820 | A | 8/1993 | Radermacher et al. | |
| 5,729,993 | A * | 3/1998 | Boiarski et al. | 62/175 |
| 5,848,537 | A * | 12/1998 | Biancardi et al. | 62/324.6 |
| 6,063,305 | A * | 5/2000 | Gage et al. | 252/67 |
| 6,070,420 | A * | 6/2000 | Biancardi et al. | 62/114 |
| 6,109,020 | A * | 8/2000 | Liebig | 60/39.182 |
| 6,176,102 | B1 * | 1/2001 | Novak et al. | 62/612 |
| 6,327,866 | B1 * | 12/2001 | Novak et al. | 62/114 |
| 6,662,576 | B1 | 12/2003 | Bai | |
| 6,769,269 | B2 * | 8/2004 | Oh et al. | 62/507 |
| 2004/0123608 | A1 | 7/2004 | Kamimura et al. | |
| 2008/0302116 | A1 | 12/2008 | Kurita et al. | |
| 2012/0047924 | A1 | 3/2012 | Li | |

FOREIGN PATENT DOCUMENTS

| | | |
|---|---|---|
| EP | 0583905 A1 | 7/1993 |

OTHER PUBLICATIONS

International search report issued in connection with WO Application No. PCT/US2013/040845, Nov. 20, 2013.

* cited by examiner

*Primary Examiner* — Mohammad M Ali
(74) *Attorney, Agent, or Firm* — Global Patent Operation; Douglas D. Zhang

(57) ABSTRACT

A dual evaporator refrigerator appliance includes a compressor, a condenser, a first evaporator, a second evaporator and a separating component coupled to the condenser and an input of the first evaporator and an input of the second evaporator and configured to separate a refrigerant stream received by the condenser into a first refrigerant stream and a second refrigerant stream. The refrigerant stream received by the separating component comprises a zeotropic refrigerant mixture. The first evaporator and the second evaporator are configured to substantially simultaneously receive the first refrigerant stream and the second refrigerant stream, respectively.

14 Claims, 3 Drawing Sheets

DUAL EVAPORATOR REFRIGERATION SYSTEM USING ZEOTROPIC REFRIGERANT MIXTURE

BACKGROUND OF THE INVENTION

The subject matter disclosed herein relates to dual evaporator refrigerator appliances, and more particularly to increasing energy efficiency in such a dual evaporator refrigerator appliance.

Many refrigerator appliances are based on a vapor-compression refrigeration technique. In such a refrigeration technique, a refrigerant serves as the medium that absorbs and removes heat from the space to be cooled, and transfers the heat elsewhere for rejection.

The evaporator is the part of the refrigeration system through which the refrigerant passes to absorb and remove the heat in the compartment being cooled (e.g., freezer compartment or fresh food compartment). Some refrigerator appliances are designed to have two separate evaporators, for example, one serving as an evaporator in a freezer compartment of the refrigerator (i.e., a freezer evaporator) and the other serving as an evaporator in a fresh food compartment of the refrigerator (i.e., a fresh food evaporator).

Dual evaporator refrigeration systems have certain advantages over single evaporator refrigeration systems. For example, many dual evaporator systems have separate refrigeration cycles for the freezer compartment and the fresh food compartment. Most dual evaporator systems have isolated airflow systems and thus the airflow in the refrigerator does not circulate between both compartments as it does in a single evaporator refrigeration system. Thus, by having an isolated airflow system in a dual evaporator system, odors that come from food stored in the fresh food compartment do not carry into the freezer compartment and then settle in ice cubes made in the freezer compartment causing unpleasant tastes when consuming the ice cubes.

However, most existing dual evaporator refrigeration systems are known to be costly and more complex than single evaporator refrigeration systems. Such existing dual evaporator refrigeration systems are also known to incur cycling losses when switching operation from the fresh food evaporator to the freezer evaporator. Still further, the evaporators in such existing systems are known to be relatively large. Such drawbacks negatively impact the energy efficiency of the appliance in which the refrigeration system resides.

BRIEF DESCRIPTION OF THE INVENTION

As described herein, the exemplary embodiments of the present invention overcome one or more disadvantages known in the art.

One embodiment relates to a dual evaporator refrigerator appliance. The appliance comprises a compressor, a condenser comprising a first portion and a second portion and configured to receive a refrigerant stream comprising a zeotropic refrigerant mixture from the compressor, a first evaporator, a second evaporator and a separating component connected between the first and second portions of the condenser to receive a refrigerant stream from the first portion of the condenser, and configured to separate the refrigerant stream received thereby into a first refrigerant stream which flows to the first evaporator and a second refrigerant stream, which flows through the second portion of the condenser to the second evaporator. By this arrangement, the first evaporator and the second evaporator substantially simultaneously receive the first refrigerant stream and the second refrigerant stream, respectively, whereby both evaporators are in operation at the same time.

Another embodiment relates to a dual evaporator refrigerator appliance. The appliance includes a compressor, a condenser comprising a first portion and a second portion and configured to receive a refrigerant stream comprising a zeotropic refrigerant mixture from the compressor, a freezer evaporator; a fresh food evaporator; and a separating component connected between the first and second portions of the condenser to receive a refrigerant stream from the first portion of the condenser, and configured to separate the refrigerant stream received thereby into a fresh food refrigerant stream which flows to the fresh food evaporator and a freezer refrigerant stream, which flows through the second portion of the condenser to the freezer evaporator. By this arrangement, the freezer evaporator and the fresh food evaporator substantially simultaneously receive the freezer refrigerant stream and the fresh food refrigerant stream, respectively whereby both evaporators are in operation at the same time.

These and other embodiments of the invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that embodiments of the invention are not intended to be limited to use in household refrigerators. Rather, embodiments of the invention may be applied to and deployed in any other suitable environments in which it would be desirable to improve energy efficiency in the case of a dual evaporator system.

Figure 1:
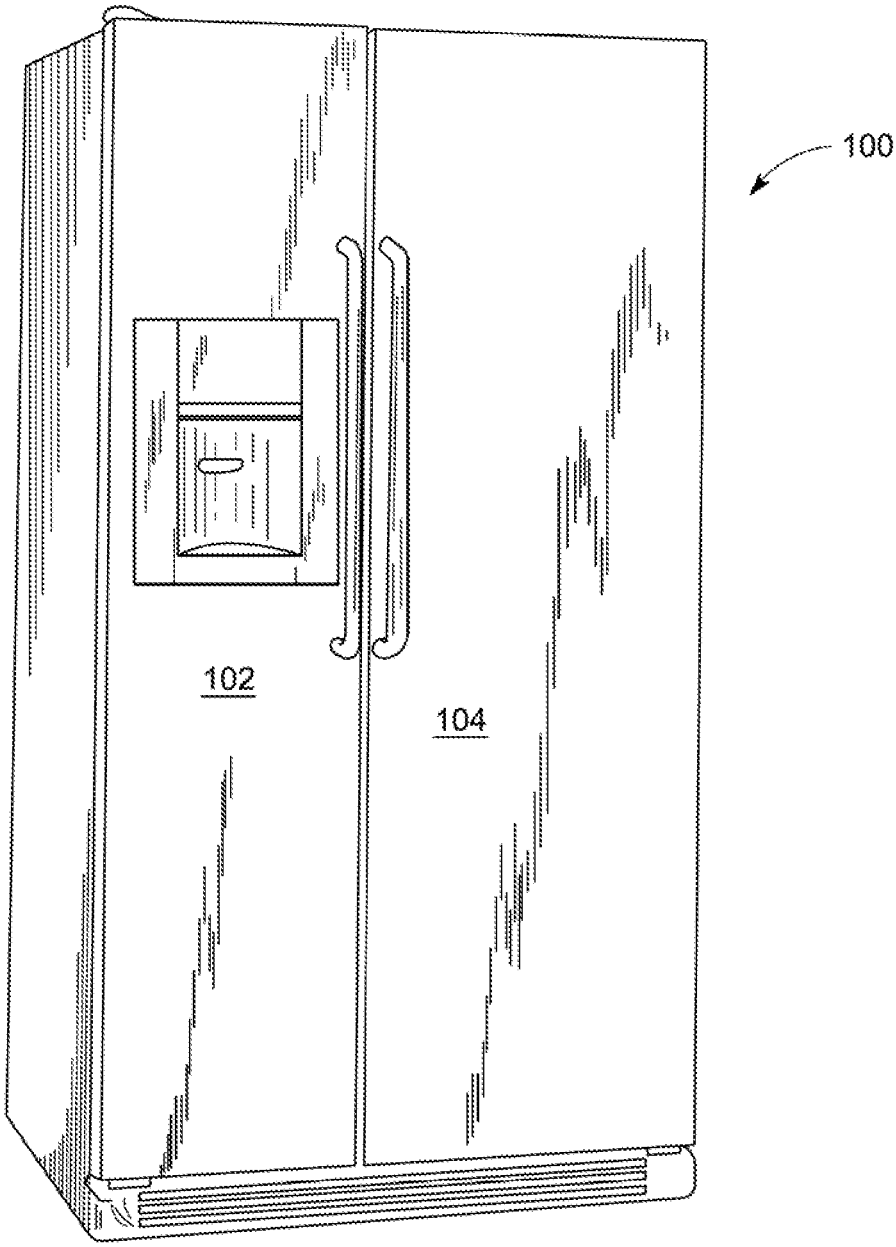
FIG. 1 is a diagram of a refrigerator, in accordance with one embodiment of the invention.

FIG. 1 illustrates an exemplary refrigerator appliance 100 within which embodiments of the invention may be implemented. As is typical, a refrigerator has a freezer compartment 102 and a fresh food compartment 104. The fresh food compartment typically maintains foods and products stored therein at temperatures at or below about 40 degrees Fahrenheit in order to preserve the items therein, and the freezer compartment typically maintains foods and products at temperatures below about 32 degrees Fahrenheit in order to freeze the items therein.

As mentioned above, in a dual evaporator system, one evaporator is used to cool the freezer compartment 102 and another evaporator is used to cool the fresh food compartment 104.

While the exemplary refrigerator 100 in FIG. 1 illustrates the freezer compartment 102 and the fresh food compartment 104 in a side-by-side configuration, it is to be understood that other configurations are known, such as top freezer (top mount) configurations where the freezer compartment 102 is situated on top of the fresh food compartment 104, and bottom freezer (bottom mount) configurations where the freezer compartment 102 is situated below the fresh food compartment 104. Also, viewing the refrigerator 100 from the front, the freezer compartment 102 may be located to the right of the fresh food compartment 104, as opposed to being located to the left as shown in FIG. 1.

It is to be appreciated that embodiments of the invention may be implemented in the refrigerator 100. However, methods and apparatus of the invention are not intended to be limited to implementation in a refrigerator such as the one depicted in FIG. 1. That is, the inventive methods and apparatus may be implemented in other household refrigerator appliances, as well as non-household (e.g., commercial) refrigerator appliances. Furthermore, such inventive methods and apparatus may be generally implemented in any appropriate refrigeration system.

As mentioned above, existing dual evaporator refrigeration systems typically run the freezer evaporator cycle and the fresh food evaporator cycle in sequential order, i.e., first one and then the other. As mentioned above, such configurations incur cycling losses when switching operation from the fresh food evaporator to the freezer evaporator, thus resulting in energy inefficiencies.

To overcome this and other problems with existing approaches, embodiments of the invention provide an improved refrigeration system that captures more of the energy savings available from the use of a dual evaporator system. That is, embodiments of the invention provide configurations for cooling each compartment (freezer and fresh food) substantially simultaneously. This approach provides for better temperature and humidity control than is possible in existing dual evaporator systems where temperature and humidity gradients in the non-cooled compartment can be problematic.

Advantageously, as will be explained in the context of one or more illustrative embodiments, the substantially simultaneous operation of both evaporators allows the refrigeration system to operate more efficiently than would otherwise be the case with existing dual evaporator refrigeration systems. As will be further explained, one or more illustrative embodiments use a zeotropic mixture of different refrigerants as the operating refrigerant for the refrigeration system. As is known, a "zeotropic mixture" is a mixture of two or more refrigerants having different boiling temperatures (at the same pressure). Consequently, the concentration of the constituent fluids is different in the liquid and vapor phases. These fluids are characterized by a temperature glide which means that the boiling and condensation temperatures change as the fluid changes phase. This is in contrast to an azeotropic mixture of fluids where the boiling and condensation temperatures of the constituent refrigerants are the same at a given pressure and the concentration of the constituents is similar in both the liquid and vapor phases.

Further, it is realized that new government regulations and consumer demand strongly encourage the development of low energy use appliances. The refrigeration system described herein reduces energy use in a very cost effective manner, while providing all the benefits expected from a dual evaporator system. These benefits include, but are not limited to, better food preservation, internal condensation prevention, and elimination of odor transfer between compartments.

Figure 2:
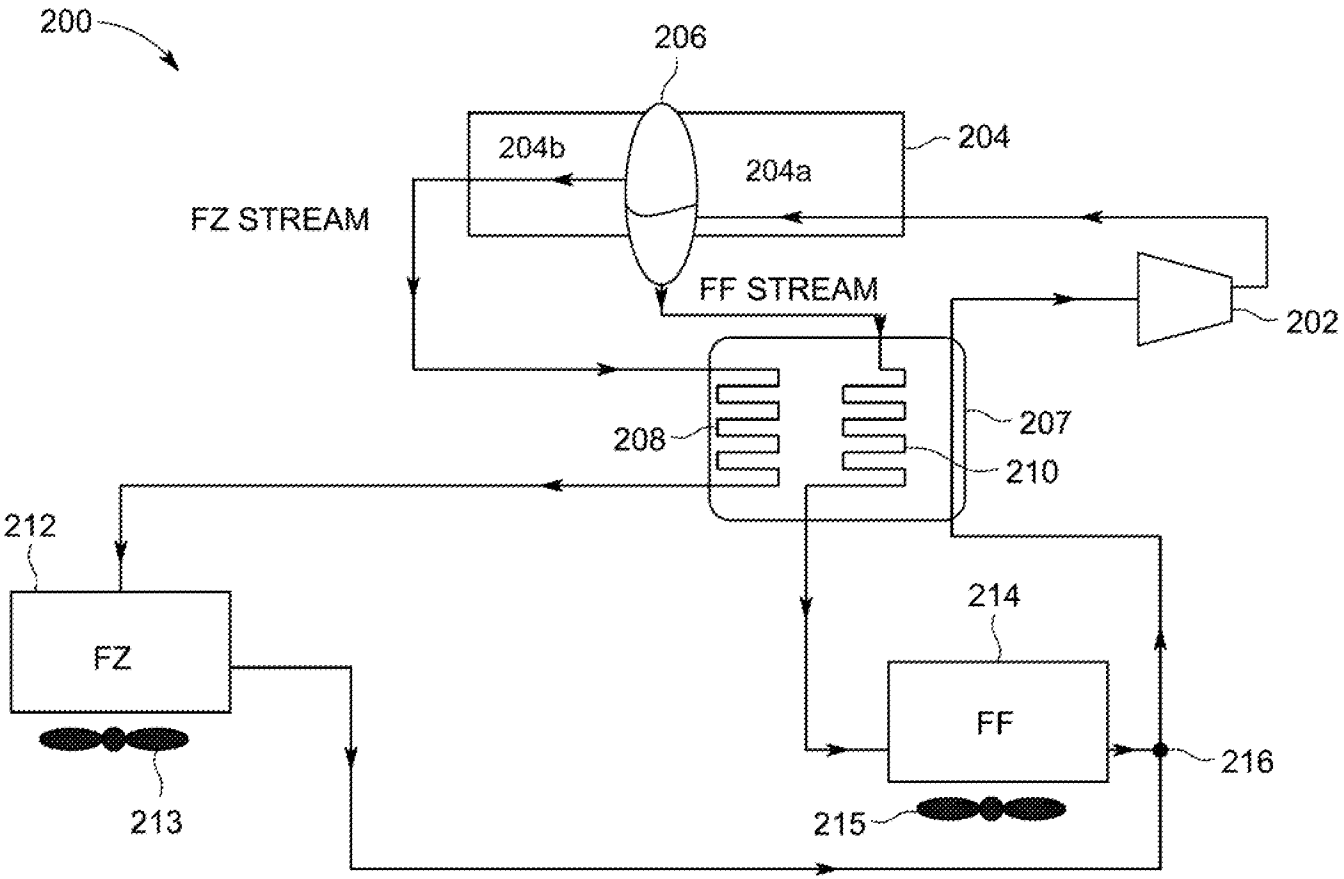
FIG. 2 is a diagram of a dual evaporator refrigeration system, in accordance with one embodiment of the invention.

FIG. 2 is a diagram of a dual evaporator refrigeration system, comprising one compressor, one condenser and two evaporators in accordance with one embodiment of the invention. It is to be understood that the dual evaporator refrigeration system 200 of FIG. 2 may be implemented in the refrigerator 100 in FIG. 1. That is, one of the two evaporators is used to cool the freezer compartment 102 and the other one is used to cool the fresh food compartment 104.

As shown, the refrigeration system 200 includes a compressor 202, a condenser 204 comprising a first portion **204*a* and a second portion 204*b*, a phase separating component 206 connected to the condenser between the first and second portions, a set of pressure reducing devices 207 including a first reducer 208 and a second reducer 210, a freezer evaporator 212 with a first fan 213, a fresh food evaporator 214 with a second fan 215, and a refrigerant stream union point 216**. In the illustrative embodiment, the reducing devices are capillary tubes, each of which is configured in heat exchange relationship with its associated refrigerant line in conventional manner well known in the art.

The refrigeration system 200 shown in FIG. 2 uses a circulating refrigerant as the medium which absorbs and removes heat from the compartments to be cooled and subsequently expels the heat elsewhere. A refrigerant is a compound used in a heat cycle that reversibly undergoes a phase change from a gas to a liquid. As mentioned above, embodiments of the invention use a zeotropic mixture of refrigerants as the operating refrigerant.

A non-flammable zeotropic mixture would likely contain predominately hydrofluorocarbons. Examples of refrigerants used in a zeotropic mixture that would not be flammable include but are not limited to R-134a, R245fa, R245ca and small amounts of R-600, R-600a or R-1234yf. Examples of refrigerants that may be used in a mixture with low Global Warming Potential (GWP) include R-600, R-600a, pentane, 8290 and R-1234yf. A low GWP mixture would likely be predominately hydrocarbons and consequently would likely be flammable.

As will be explained in illustrative embodiments herein, different mixture percentages of refrigerants are used in the dual evaporator refrigerant system. Examples of various illustrative zeotropic mixtures will be given below. While certain older refrigerants are being phased out and replaced by environmentally-friendlier compounds, it is to be understood that embodiments of the invention are not limited to any particular refrigerant.

Referring again to FIG. 2, the zeotropic refrigerant mixture in the refrigeration system enters the compressor 202 in a thermodynamic state known as a "superheated vapor" and is compressed to a higher pressure in the compressor 202, resulting in a higher temperature as well. The hot, compressed vapor exiting the compressor 202 is still in a thermodynamic state known as a "superheated vapor," but it is now at a temperature and pressure at which it can be condensed at the temperature of the available cooling medium, for example the ambient air surrounding the refrigerator appliance.

In one embodiment, the refrigerant mixture exiting compressor 202 is about 30% R-134a and about 70% R-600a (i.e., a percent ratio of 30/70), at a temperature of about 117 degrees (Fahrenheit) and a pressure of about 114 psia. As is known, R-134a is a higher temperature refrigerant as compared to R-600a, i.e., the temperature at which R-134a refrigerant changes from a gas back to a liquid is higher than the temperature at which R-600a changes from a gas back to a liquid when subject to the same pressure.

The hot vapor mixture is routed to the condenser 204 where, in general, it is cooled and condensed into a liquid by flowing through a coil or tubes with cooling air flowing across the coil or tubes of the condenser. The cooling air may typically be air in the room in which the refrigerator operates. It is to be understood that the condenser 204 is where the circulating zeotropic refrigerant mixture rejects heat from the system and the rejected heat is carried away by the air.

However, in accordance with an embodiment of the invention, the zeotropic refrigerant mixture is separated in the condenser 204 via separating component 206, which may be a phase separator or a membrane. The phase separator or membrane 206 separates the refrigerant into two different refrigerant streams, each stream having a different percentage ratio of R-134a and R-600a as compared to the other stream, and as compared to the refrigerant entering the condenser.

In the illustrative embodiment, the phase separator is a bottle disposed in the condenser refrigerant line roughly midway through the condenser where the fluid is in part condensed liquid and in part uncondensed vapor thereby dividing the condenser into a first portion 204*a* and a second portion 204*b*. The phase separator is configured such that the velocity of the refrigerant through the bottle is slow enough that a liquid layer forms at the bottom due to gravity and the vapor rises to the top of the bottle. Thus, a liquid phase mixture richer in the higher temperature refrigerant (R-134a) is separated from near the middle of the condenser 204 and sent to the second reducer 210 and then to the fresh food evaporator 214. The vapor in the bottle proceeds on through the second portion 204*b* of the condenser 204 where it condenses to a liquid phase mixture rich in the lower temperature refrigerant (R-600a) which exits the condenser at the end of the condenser 204 and is sent to the first reducer 208 and then to the freezer evaporator 212.

In the illustrative example, the fresh food (FF) refrigerant stream exits the condenser via the phase separator at about 44.5% R-134a and about 55.5% R-600a (i.e., a percent ratio of 44.5/55.5), at a temperature of about 105 degrees (Fahrenheit) and a pressure of about 114 psia. The freezer (FZ) refrigerant stream exits the condenser at about 15.5% R-134a and about 84.5% R-600a (i.e., a percent ratio of 15.5/84.5), at a temperature of about 94 degrees (Fahrenheit) and a pressure of about 114 psia.

The condensed refrigerant mixture destined for the freezer evaporator 212 (FZ stream), in a thermodynamic state known as a "saturated liquid," is routed to the first reducer 208. The refrigerant undergoes a reduction in pressure in the first reducer 208. That pressure reduction results in the evaporation of a part of the liquid refrigerant. The lower pressure lowers the temperature of the liquid and vapor refrigerant mixture to where it is colder than the temperature of the enclosed compartment to be refrigerated. From the first reducer 208, the refrigerant mixture goes to the freezer evaporator (FZ) 212 (i.e., evaporator in the freezer compartment of the refrigerator).

Likewise, the condensed refrigerant mixture destined for the fresh food evaporator 214 (FF stream) is routed to the second reducer 210 where it undergoes a pressure reduction. From the second reducer 210, the refrigerant mixture goes to the fresh food evaporator (FF) 214 (i.e., evaporator in the fresh food compartment of the refrigerator). Thus, it is to be understood that refrigerant streams pass substantially simultaneously to the two evaporators 212 and 214 in the system so that they can operate at substantially the same time.

In each compartment to be cooled by an evaporator, a fan (213 in FZ and 215 in FF) circulates the warm air in the enclosed compartment across the coil or tubes of the evaporator carrying the cold refrigerant liquid and vapor mixture. The warm air evaporates the liquid part of the cold refrigerant mixture. At the same time, the circulating air is cooled and thus lowers the temperature of the enclosed compartment to a desired temperature. It is to be understood that the evaporator is where the circulating refrigerant absorbs and removes heat which is subsequently rejected in the condenser 204 and transferred elsewhere by the water or air used in the condenser. While the illustrative embodiments herein described, utilize both a freezer evaporator fan and a fresh food evaporator fan, it is to be understood that a natural draft or convection air flow configuration well known in the art, could be employed for circulating air over the fresh food evaporator in lieu of a fresh food fan.

To complete the refrigeration cycle, the refrigerant vapor exits each evaporator as a "saturated vapor." The refrigerant vapor stream exiting the freezer evaporator 212 and the refrigerant vapor stream exiting the fresh food evaporator 214 are combined at stream union point 216 and routed back to the compressor 202. Advantageously, the refrigerants in both evaporators evaporate at the same pressure (in this example, at about 16 pounds per square inch absolute or psia). Consequently, the union of the suction lines from the two evaporators can simply be joined without need for any special devices or structure, such as a valve, pump or venturi. The refrigerant FF/FZ cycle is then repeated.

The refrigerant mixture is selected to provide the desired freezer and evaporator evaporation temperatures. The desired evaporation temperature for the refrigerant in the freezer evaporator 212 is typically about −10 degrees (Fahrenheit) on average. This is a typical evaporating temperature for a zero degree freezer setting. The fresh food evaporation (214) temperature is should not exceed about 20 degrees (Fahrenheit) to minimize the required evaporator size. In one illustrative embodiment, the fresh food evaporation temperature is about 5.4 degrees (Fahrenheit) on average. Mixtures that produce warmer fresh food evaporator temperatures are expected to be more efficient.

Figure 3:
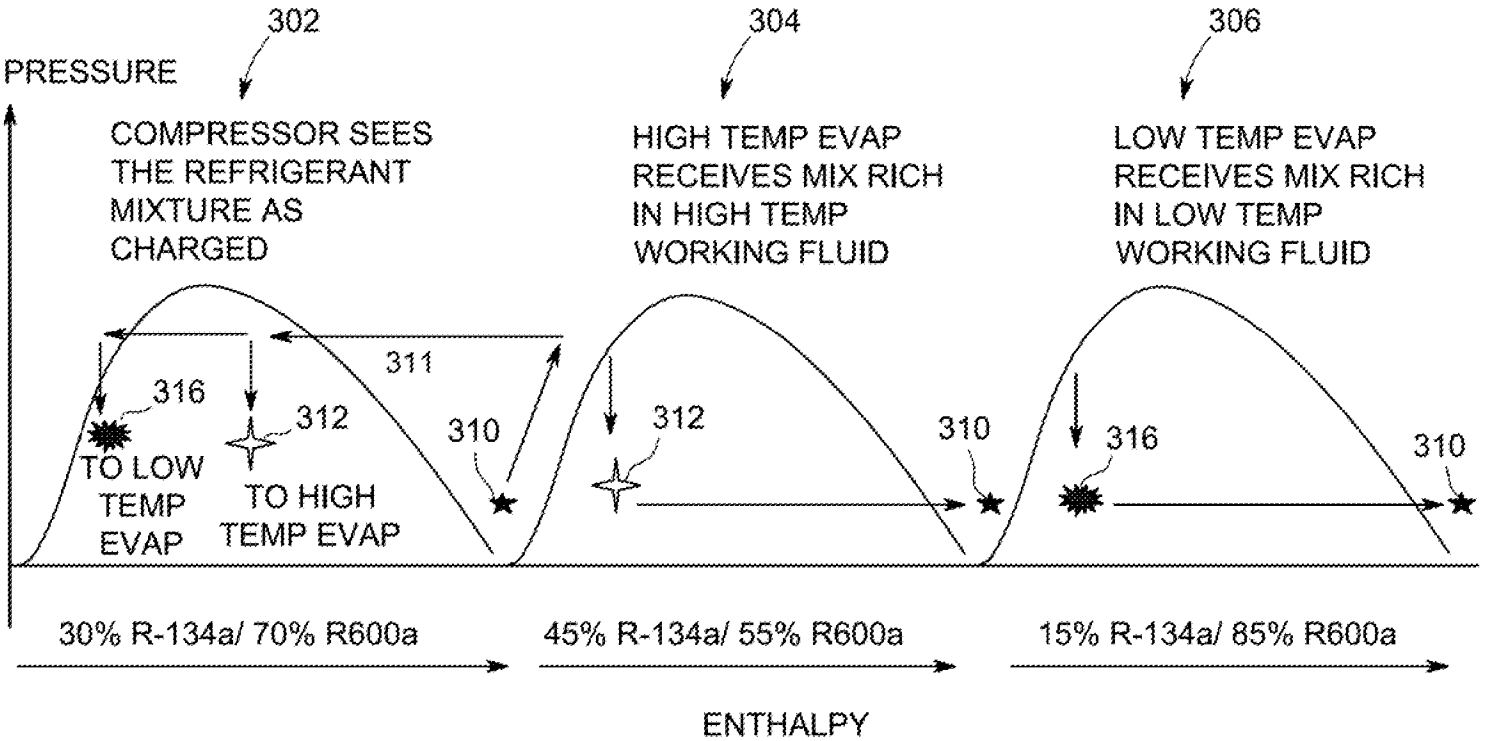
FIG. 3 is a diagram illustrating a relationship between pressure and enthalpy in a dual evaporator refrigeration system, in accordance with an embodiment of the invention.

FIG. 3 presents a set of three pressure enthalpy graphs, 302, 304 and 306. Graph 302 represents the refrigerant mixture in the system as it passes through the compressor and the condenser; graph 304 represents the refrigerant mixture passing through the high temperature evaporator 214; and graph 306 represents the refrigerant mixture passing through the low temperature evaporator 216 in FIG. 2. It is to be understood that these graphs are intended to be qualitative representations to illustrate generally how the system achieves the two different evaporating temperatures for the high and low temperature evaporators. The pressure scale is the same for each of the three diagrams (graphs) shown in FIG. 3. However, the enthalpy scale is different for each concentration of constituent refrigerant. For example, the enthalpy of a 30% R-134a/70% R-600a mix is less than that of 15% R-134a/85% R-600a mix throughout this cycle. The lines of constant temperature are different as well.

Referring first to graph 302, starting at the point marked with the five point star (labeled 310), the mix of refrigerants at the inlet of the compressor is that which is charged into the system. The pressure of this refrigerant is raised in the compressor 202 (labeled 311) and the refrigerant is then sent to the condenser 204. As the refrigerant is condensed, represented as movement from right to left from 311*a* liquid mixture rich in the higher temperature refrigerant forms and is separated (206) and sent to the high temperature evaporator (214). This mix is depicted with a four point star (labeled 312). The evaporation of this refrigerant is illustrated in graph 304 as following the line from 312 to 310 as the fluid transitions from saturated liquid to saturated vapor at a constant temperature in the range of 0 to 10 degrees F. The remaining vapor refrigerant is then sent on to the second half of the condenser 204 where it is liquefied and sent to the low temperature evaporator (212). This mix is depicted by jagged symbol (labeled 316). The transition of this fluid from saturated liquid to saturated vapor is shown in graph 306 as following the line from 316 to 310 at a constant temperature in the range of −15 to −5 degrees F. The refrigerants are combined (216) before entering the compressor 202 and repeating the cycle.

While FIGS. 2 and 3 have been explained above in the context of one particular example of a zeotropic refrigerant mixture (refrigerant mixture exiting compressor 202 is about 30% R-134a and about 70% R-600a), it is to be appreciated that alternative embodiments of the invention may use other zeotropic refrigerant mixtures.

By way of further example, a non-flammable zeotropic mixture may include, as charged (i.e., exiting the compressor 202), about 33% R-245fa, about 66% R-134a and about 1% butane. The mixture that goes to the fresh food evaporator (exiting separating component 206) is about 44.83% R-245fa, about 54.6% R-134a and about 0.56% butane, while the mixture that goes to the freezer evaporator (exiting separating component 206) is about 21.1% R-245fa, about 77.4% R-134a and about 1.4% butane.

R-245ca can be substituted for R-245fa to achieve an improved performance. Also, R-1234yf can be substituted for butane.

By way of yet another example, a low GWP zeotropic mixture may include, as charged (i.e., exiting the compressor 202), about 7% pentane, about 36% butane, about 47% isobutane and about 10% propane. The mixture that goes to the fresh food evaporator (exiting separating component 206) is about 10.67% pentane, about 39.32% butane, about 44.28% isobutane and about 5.72% propane, while the mixture that goes to the freezer evaporator (exiting separating component 206) is about 3.33% pentane, about 32.68% butane, about 49.72% isobutane and about 14.28% propane.

In the embodiment described herein, the zeotropic refrigerant mixture approach whereby the fresh food evaporator and the freezer evaporator substantially simultaneously receive refrigerant, the system delivers all the benefits expected from a dual evaporator system at a much lower cost and complexity. There are fewer parts, e.g., no damper, no refrigerant flow valve and no check valve are needed. The manufacturing of the refrigeration system is simpler and more repeatable. There are no cycling losses when switching refrigerant between fresh food and freezer evaporators as occurs in existing dual evaporator systems. Further, the split refrigerant flow reduces the need for large evaporators because both evaporators are being used simultaneously. The smaller evaporators require less internal volume versus a traditional dual evaporator system. Still further, the system eliminates issues with very short fresh food cooling cycles such as temperature and humidity management.

It is to be appreciated that one ordinarily skilled in the art will realize that well-known heat exchange and heat transfer principles may be applied to determine appropriate dimensions and materials of the various assemblies illustratively described herein, as well as flow rates of refrigerant that may be appropriate for various applications and operating conditions, given the inventive teachings provided herein. While methods and apparatus of the invention are not limited thereto, the skilled artisan will realize that such rates, dimensions and materials may be determined and selected in accordance with well-known heat exchange and heat transfer principles.

It is to be further appreciated that temperature control for the embodiments herein described may be implemented in conventional manner well known to those ordinarily skilled in the art. For example, the cooling system may be configured to respond to the temperature in the fresh food compartment, freezer compartment or a value calculated from a combination of temperatures. More particularly, a temperature sensor monitors the temperature in the each compartment. When the temperature exceeds the reference turn-on temperature associated with the user selected set point temperature for the compartment, the controller will turn on the compressor. When the temperature drops below the reference turn-off temperature associated with the set point temperature, the compressor is turned off. When the compressor is on, refrigerant circulates through both evaporators. Additional control may be exercised by controlling the associated evaporator fan speeds as a function of temperature in the respective compartments.

It is to be further appreciated that the refrigeration systems described herein may have control circuitry including, but not limited to, a microprocessor (processor) that is programmed, for example, with suitable software or firmware, to implement one or more techniques as described herein. In other embodiments, an ASIC (Application Specific Integrated Circuit) or other arrangement could be employed. One of ordinary skill in the art will be familiar with refrigeration systems and given the teachings herein will be enabled to make and use one or more embodiments of the invention; for example, by programming a microprocessor with suitable software or firmware to cause the refrigeration system to perform illustrative steps described herein. Software includes but is not limited to firmware, resident software, microcode, etc. It is to be further understood that part or all of one or more features of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Furthermore, it is also to be appreciated that embodiments of the invention may be implemented in electronic systems under control of one or more microprocessors and computer readable program code, as described above, or in electromechanical systems where operations and functions are under substantial control of mechanical control systems rather than electronic control systems.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A dual evaporator refrigerator appliance comprising:

a compressor;

a condenser configured to receive a refrigerant stream from the compressor, comprising a first portion and a second portion, and wherein the refrigerant stream received from the compressor comprises a zeotropic refrigerant mixture;

a first evaporator;

a second evaporator; and a separating component connected between the first and second portions of the condenser to receive a refrigerant stream from the first portion of the condenser, and configured to separate the refrigerant stream received thereby into a first refrigerant stream which flows to the first evaporator and a second refrigerant stream, which flows through the second portion of the condenser to the second evaporator, whereby the first evaporator and the second evaporator substantially simultaneously receive the first refrigerant stream and the second refrigerant stream, respectively.

2. The dual evaporator refrigerator appliance of claim 1, wherein the zeotropic refrigerant mixture comprises two or more refrigerants selected from a group consisting of an R-134a refrigerant, an R-245fa refrigerant, an R-245ca refrigerant, an R-1234yf refrigerant, an R-600a refrigerant, pentane, butane, isobutane and propane.

3. The dual evaporator refrigerator appliance of claim 1, wherein the zeotropic refrigerant mixture comprises an R-134a refrigerant and an R-600a refrigerant.

4. The dual evaporator refrigerator appliance of claim 1, wherein the zeotropic refrigerant mixture comprises an R-134a refrigerant, an R-245fa refrigerant and butane.

5. The dual evaporator refrigerator appliance of claim 1, wherein the zeotropic refrigerant mixture comprises an R-134a refrigerant, an R-245fa refrigerant and an R-1234yf refrigerant.

6. The dual evaporator refrigerator appliance of claim 1, wherein the zeotropic refrigerant mixture comprises an R-134a refrigerant, an R-245ca refrigerant and butane.

7. The dual evaporator refrigerator appliance of claim 1, wherein the zeotropic refrigerant mixture comprises an R-134a refrigerant, an R-245ca refrigerant and an R-1234yf refrigerant.

8. The dual evaporator refrigerator appliance of claim 1, wherein the zeotropic refrigerant mixture comprises pentane, butane, isobutane and propane.

9. The dual evaporator refrigerator appliance of claim 1, wherein the zeotropic refrigerant mixture comprises a first refrigerant and a second refrigerant, wherein the temperature at which the first refrigerant changes from a gas to a liquid is higher than the temperature at which the second refrigerant changes from a gas to a liquid when at the same pressure.

10. The dual evaporator refrigerator appliance of claim 9, wherein the first refrigerant stream generated by the separating component is a liquid phase mixture richer in the first refrigerant, while the second refrigerant stream generated by the separating component is a liquid phase mixture richer in the second refrigerant.

11. The dual evaporator refrigerator appliance of claim 1, wherein the first refrigerant stream exiting the first evaporator and the second refrigerant stream exiting the second evaporator merge to form a combined refrigerant stream.

12. A dual evaporator refrigerator appliance comprising:

a compressor;

a condenser configured to receive a refrigerant stream from the compressor, and comprising a first portion and a second portion, and wherein the refrigerant stream received from the compressor comprises a zeotropic refrigerant mixture;

a freezer evaporator;

a fresh food evaporator; and a separating component connected between the first and second portions of the condenser to receive a refrigerant stream from the first portion of the condenser, and configured to separate the refrigerant stream received thereby into a fresh food refrigerant stream which flows to the fresh food evaporator and a freezer refrigerant stream, which flows through the second portion of the condenser to the freezer evaporator, whereby the freezer evaporator and the fresh food evaporator substantially simultaneously receive the freezer refrigerant stream and the fresh food refrigerant stream, respectively.

13. The dual evaporator refrigerator appliance of claim 12, wherein the zeotropic refrigerant mixture comprises a first refrigerant and a second refrigerant, wherein the temperature at which the first refrigerant changes from a gas to a liquid is higher than the temperature at which the second refrigerant changes from a gas to a liquid when at the same pressure.

14. The dual evaporator refrigerator appliance of claim 12, wherein the zeotropic refrigerant mixture comprises a first refrigerant and a second refrigerant, wherein the fresh food refrigerant stream received from the separating component is a liquid phase mixture richer in the first refrigerant, while the freezer refrigerant stream received from the separating component is a liquid phase mixture richer in the second refrigerant.

* * * * *